US009477164B2

(12) United States Patent
Takagi et al.

(10) Patent No.: US 9,477,164 B2
(45) Date of Patent: Oct. 25, 2016

(54) ELECTROPHOTOGRAPHIC PHOTOSENSITIVE MEMBER, METHOD FOR PRODUCING THE SAME, ELECTROPHOTOGRAPHIC APPARATUS, AND PROCESS CARTRIDGE

(71) Applicant: CANON KABUSHIKI KAISHA, Tokyo (JP)

(72) Inventors: Shinji Takagi, Yokohama (JP); Koichi Nakata, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 10 days.

(21) Appl. No.: 14/514,203

(22) Filed: Oct. 14, 2014

(65) Prior Publication Data

US 2015/0104738 A1 Apr. 16, 2015

(30) Foreign Application Priority Data

Oct. 15, 2013 (JP) ..... 2013-214819
Aug. 29, 2014 (JP) ..... 2014-176308

(51) Int. Cl.
*G03G 5/147* (2006.01)
*G03G 5/07* (2006.01)
*G03G 5/05* (2006.01)

(52) U.S. Cl.
CPC ..... *G03G 5/14773* (2013.01); *G03G 5/0546* (2013.01); *G03G 5/0589* (2013.01); *G03G 5/0592* (2013.01); *G03G 5/071* (2013.01); *G03G 5/14734* (2013.01); *G03G 5/14791* (2013.01)

(58) Field of Classification Search
CPC ..... G03G 5/14773; G03G 5/0592; G03G 5/14791; G03G 5/14734; G03G 5/0546; G03G 5/0589; G03G 5/071
USPC ..... 430/56, 58.05, 130; 399/159
See application file for complete search history.

(56) References Cited

U.S. PATENT DOCUMENTS

2005/0019684 A1* 1/2005 Sekiya ..... G03G 5/04 430/66
2009/0270529 A1* 10/2009 Kume ..... C08F 230/08 523/122

FOREIGN PATENT DOCUMENTS

JP 62-75462 A 4/1987
JP 2006-047949 A 2/2006
JP 2008-262232 A 10/2008

* cited by examiner

*Primary Examiner* — Thorl Chea
(74) *Attorney, Agent, or Firm* — Canon U.S.A., Inc., IP Division

(57) ABSTRACT

A surface layer of an electrophotographic photosensitive member contains a cured product of a composition containing a hole transporting substance having an acryloyloxy group and/or a methacryloyloxy group and a siloxane-modified acrylic compound.

13 Claims, 1 Drawing Sheet

ELECTROPHOTOGRAPHIC PHOTOSENSITIVE MEMBER, METHOD FOR PRODUCING THE SAME, ELECTROPHOTOGRAPHIC APPARATUS, AND PROCESS CARTRIDGE

BACKGROUND OF THE INVENTION

1. Field of the Invention

The present invention relates to an electrophotographic photosensitive member, a method for producing the same, and an electrophotographic apparatus and a process cartridge having an electrophotographic photosensitive member.

2. Description of the Related Art

For the purpose of improving the durability of an electrophotographic photosensitive member containing an organic photoconductive substance, technologies have been explored to improve materials, characteristics, and other features of the surface of an electrophotographic photosensitive member.

Japanese Patent Laid-Open No. 2008-262232 describes that the surface layer of an electrophotographic photosensitive member contains a polymer of a hole transporting substance having a chain-polymerizable functional group and also contains a lubricant so that the wear resistance and potential characteristics during repeated use should be improved.

Furthermore, for the purpose of improving cleaning performance for toner that remains on an electrophotographic photosensitive member after image transfer, technologies have been explored in which the surface layer of a photosensitive member contains a lubricating substance. For example, Japanese Patent Laid-Open No. 62-75462 discloses a technology in which the surface of an electrophotographic photosensitive member contains a certain silicone-based comb-shaped graft polymer so that cleaning performance and the lubricity of the surface of the electrophotographic photosensitive member should be improved.

In recent years, it has been demanded that electrophotographic apparatus use an electrophotographic photosensitive member with improved wear resistance and the quality of images produced therewith be improved. In particular, color electrophotographic apparatus has problems such as streak-like image defects, which occur due to a reduced lubricity of an electrophotographic photosensitive member during repeated use, and image smearing, which occurs due to, conversely, too high a lubricity of an electrophotographic photosensitive member. It is therefore in demand to reduce streak-like image defects while reducing image smearing. Research conducted by the inventors has found that the electrophotographic photosensitive members described in Japanese Patent Laid-Open No. 2008-262232 and Japanese Patent Laid-Open No. 62-75462 have room for improvement because with these technologies, it can in some cases be impossible to sufficiently reduce streak-like image defects while sufficiently reducing image smearing.

Image smearing is a phenomenon manifested as a blurred output image that occurs secondary to a blurred electrostatic latent image. Researchers speculate that this is because a reaction product formed through the reaction between moisture existing on the surface of an electrophotographic photosensitive member or in the air and a corona product formed through charging alters the materials constituting the surface layer of the photosensitive member.

To reduce image smearing, a method has been used in which a drum heater is placed to increase the surface temperature of an electrophotographic photosensitive member and thereby to evaporate moisture, a factor in causing image smearing. As for streak-like image defects, a method may occasionally be used in which conditions such as the contact pressure that occurs when a cleaning blade comes into contact with an electrophotographic photosensitive member are optimized to reduce image defects. However, an electrophotographic photosensitive member that allows both streak-like image defects and image smearing to be reduced without using these methods is in demand from the viewpoints of saving the energy consumed by electrophotographic apparatus and cleaning performance for residual toner.

SUMMARY OF THE INVENTION

Certain aspects of the invention provide a highly wear-resistant electrophotographic photosensitive member that allows both streak-like image defects and image smearing to be reduced and a method for producing such an electrophotographic photosensitive member. Some other aspects of the invention provide an electrophotographic apparatus and a process cartridge having an electrophotographic photosensitive member.

An aspect of the invention relates to an electrophotographic photosensitive member having a support and a photosensitive layer formed on the support. The surface layer of the electrophotographic photosensitive member contains a cured product of a composition, and the composition contains a hole transporting substance having at least one group selected from the group consisting of an acryloyloxy group and a methacryloyloxy group and a siloxane-modified acrylic compound.

Another aspect of the invention relates to a method for producing an electrophotographic photosensitive member having a support and a surface layer formed on the support. The method includes preparing a coating liquid for forming the surface layer (a surface-layer-forming coating liquid). The coating liquid contains a hole transporting substance having at least one group selected from the group consisting of an acryloyloxy group and a methacryloyloxy group and a siloxane-modified acrylic compound. The method further includes forming a coat of the surface-layer-forming coating liquid and curing the coat to form the surface layer.

Another aspect of the invention relates to a process cartridge. The process cartridge has an electrophotographic photosensitive member described above and at least one unit selected from a charging unit, a development unit, and a cleaning unit and integrally holds the electrophotographic photosensitive member and the unit. The process cartridge is attachable to and detachable from a main body of an electrophotographic apparatus.

Another aspect of the invention relates to an electrophotographic apparatus. The electrophotographic apparatus has an electrophotographic photosensitive member described above and a charging unit, an exposure unit, a development unit, and a transfer unit.

According to an aspect of the invention, a highly wear-resistant electrophotographic photosensitive member can be provided that allows both streak-like image defects and image smearing to be reduced.

According to some other aspects of the invention, an electrophotographic apparatus and a process cartridge can be provided having such an electrophotographic photosensitive member.

Further features of the present invention will become apparent from the following description of exemplary embodiments with reference to the attached drawings.

DESCRIPTION OF THE EMBODIMENTS

Figure 1:
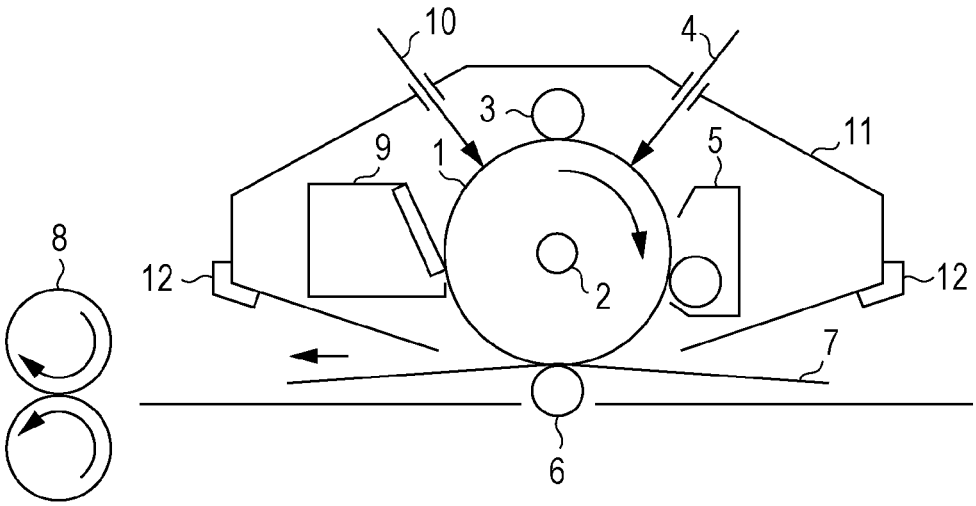
FIG. 1 is a diagram that illustrates an example of a schematic structure of an electrophotographic apparatus provided with a process cartridge having an electrophotographic photosensitive member.

An electrophotographic photosensitive member according to an embodiment of the invention has a support and a photosensitive layer. The electrophotographic photosensitive member has a surface layer containing a cured product of a composition, and the composition contains a hole transporting substance having an acryloyloxy group and/or a methacryloyloxy group and a siloxane-modified acrylic compound.

The following is the inventors' speculation on the mechanism of action by which an electrophotographic photosensitive member having this feature allows both streak-like image defects and image smearing to be reduced.

A surface layer containing a cured product of a hole transporting substance having an acryloyloxy group and/or a methacryloyloxy group has a high wear resistance, but on the other hand often causes image smearing and, when used repeatedly, streak-like image defects because of this high wear resistance. An alleged cause of streak-like image defects is that any material of toner melts and adheres to the surface of the electrophotographic photosensitive member, disturbing the behavior of the blade. The use of a lubricant such as a fluorinated compound or a siloxane compound stabilizes the behavior of the blade and thereby reduces streak-like image defects because the high surface migration potential of the lubricant (the potential of the lubricant to migrate to a surface) helps the lubricant to remain on the surface of the surface layer.

However, research conducted by the inventors found that the use of a lubricant having a high surface migration potential can make image smearing more likely to occur by excessively increasing the lubricity of the surface of the electrophotographic photosensitive member. This seems to be because too high a lubricity of the surface of an electrophotographic photosensitive member caused by the use of a lubricant often affects the performance of the electrophotographic photosensitive member in removing a corona product (a cause of image smearing) using its cleaning unit. On the other hand, streak-like image defects that occur during repeated use seem to be because the lubricant content of the surface layer is low near its surface as a result of the cleaning unit shaving the lubricant over the period of repeated use.

In an embodiment of the invention, it seems that the surface layer can maintain an adequate degree of lubricity during repeated use by containing a cured product of a composition that contains the aforementioned hole transporting substance and a siloxane-modified acrylic compound. A siloxane-modified acrylic compound is a compound having a surface migration potential and has a siloxane structure as a side chain on an acrylic backbone. With this siloxane structure, the acrylic compound exhibits lubricity. It seems that as a result of an interaction between the acrylic backbone of the siloxane-modified acrylic compound and the acryloyloxy or methacryloyloxy group of the hole transporting substance, an adequate amount of the siloxane-modified acrylic compound also exists in the inside of the surface layer with respect to the depth direction. This way of existence of the siloxane-modified acrylic compound on the surface and in the deeper inside of the surface layer provides the surface layer with an adequate lubricity, which reduces image smearing. During repeated use, seemingly, the presence of this compound in the inside of the surface layer with respect to the depth direction allows the surface layer to maintain lubricity, and this reduces streak-like image defects that occur during repeated use.

Japanese Patent Laid-Open No. 2006-47949 describes that an acryl-modified polyorganosiloxane obtained by grafting an acrylic monomer to a silicone backbone is used in the surface layer of an electrophotographic photosensitive member. Based on a silicone backbone, this acrylic-modified polyorganosiloxane should have a higher surface migration potential than that of a siloxane-modified acrylic compound, which is based on an acrylic backbone. With an acrylic-modified polyorganosiloxane, therefore, image smearing and streak-like image defects could not be sufficiently reduced together because it should be difficult to make an adequate amount of the acrylic-modified polyorganosiloxane exist in the inside of the surface layer with respect to the depth direction.

The siloxane-modified acrylic compound can be a copolymer composed of an acrylic backbone and a siloxane polymer (a silicon macromer) grafted to the acrylic backbone. An acrylic backbone should provide the compound with an adequate surface migration potential. The siloxane structure content of the siloxane-modified acrylic compound can be 2% by mass or more and 15% by mass or less. The siloxane-modified acrylic compound may be soluble in alcohol. A specific example is a siloxane-modified acrylic compound having a solubility of 1% by mass or more in 1-propanol. This solubility is a value measured under room temperature and atmospheric pressure conditions (25° C. and 1 atm). When meeting this solubility condition, the siloxane-modified acrylic compound dissolves in 1-propanol used as a solvent in a coating liquid for forming a surface layer, and while the surface layer is being formed, this helps the acrylic compound to exist on the surface and in the deeper inside of the surface layer as described above. The siloxane-modified acrylic compound may be one that has no styrene-derived structure.

Examples of commercially available siloxane-modified acrylic compounds include BYK-3550 (BYK Japan KK). BYK-3550 is a solution containing a siloxane-modified acrylic compound (a 52 mass % methoxypropyl acetate solution [methoxypropyl acetate content: 52% by mass]).

Figure 2:
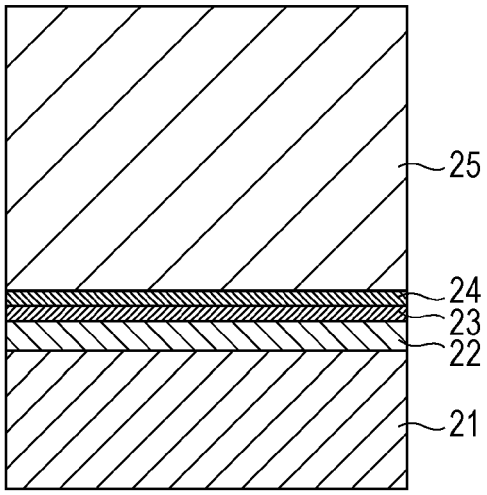
FIG. 2 is a diagram for describing a layer structure of an electrophotographic photosensitive member.

An electrophotographic photosensitive member according to an embodiment of the invention has a support and a photosensitive layer (a charge generating layer and a charge transporting layer) formed on the support. FIG. 2 is a diagram that illustrates an example of a layer structure of an electrophotographic photosensitive member. In FIG. 2, the electrophotographic photosensitive member has a support 21, an undercoat layer 22, a charge generating layer 23, a charge transporting layer 24, and a protective layer 25. In this case, the protective layer 25 is the surface layer.

Surface Layer

The surface layer contains a cured product of a composition, and the composition contains a hole transporting substance having an acryloyloxy group or a methacryloyloxy group and also contains a siloxane-modified acrylic compound. In an embodiment of the invention, the surface layer can be a protective layer formed on a charge transporting layer.

The hole transporting substance can be a compound represented by formula (1).

$$(P_1—Z—)_aA \quad (1)$$

In formula (1), A represents a hole transporting group. Z represents a single bond or a substituted or unsubstituted alkylene group having 1 to 6 carbon atoms along a backbone. $P^1$ represents an acryloyloxy group or a methacryloyloxy group. "a" is an integer of 1 to 4, and when "a" is 2 or more, the 2 or more $P^1$s may be the same as or different from one another. Examples of hole transporting groups include a group derived through the removal of hydrogen atoms from the benzene rings of a triarylamine compound, a group derived through the removal of hydrogen atoms from the benzene rings of a hydrazone compound, and a group derived through the removal of hydrogen atoms from the benzene rings of a stilbene compound.

A hydrogen adduct derived through the substitution of the site where A and $P^1$ are bonded in formula (1) with a hydrogen atom may be a compound represented by formula (7) or (8).

(7)

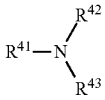

(8)

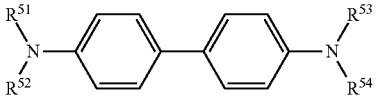

(In formula (7), $R^{41}$, $R^{42}$, and $R^{43}$ represent a substituted or unsubstituted phenyl group. $R^{41}$, $R^{42}$, and $R^{43}$ may be the same as or different from one another. In formula (8), $R^{51}$, $R^{52}$, $R^{53}$, and $R^{54}$ represent a substituted or unsubstituted phenyl group. $R^{51}$, $R^{52}$, $R^{53}$, and $R^{54}$ may be the same as or different from one another. An example of a substituent of a substituted phenyl group is an alkyl group containing 1 to 6 carbon atoms.)

The following presents some specific examples of hole transporting substances having an acryloyloxy group or a methacryloyloxy group (illustrative compounds).

(1-1)

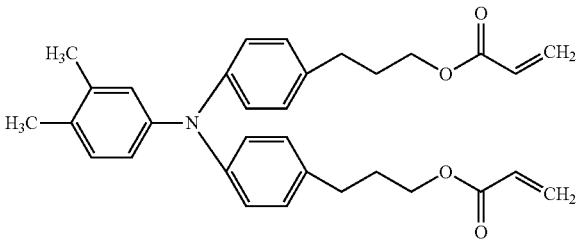

-continued (1-2)

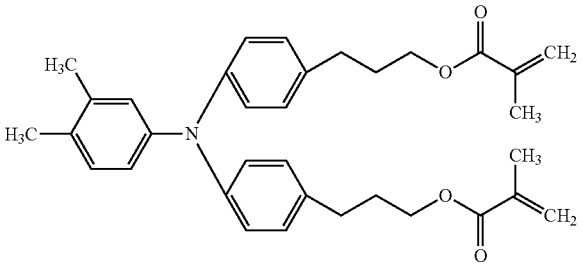

(1-3)

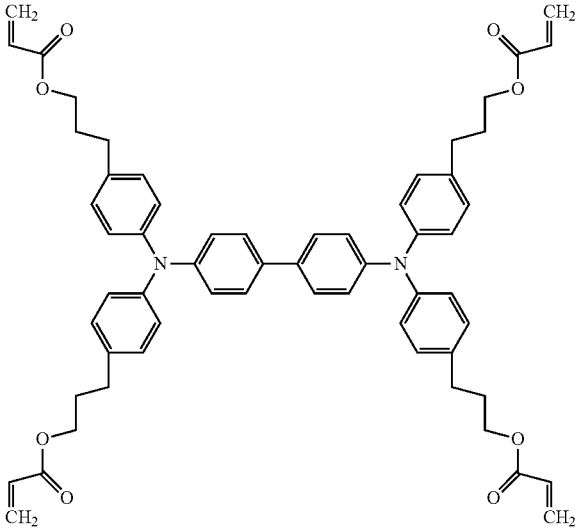

An example of an index of the presence of the siloxane-modified acrylic compound in the surface layer is the ratio of silicon atoms to all atoms excluding hydrogen atoms as measured using X-ray photoelectron spectroscopy (XPS). More specifically, the following situation is possible.

The ratio of silicon atoms to all atoms excluding hydrogen atoms at the uppermost surface of the surface layer as measured using X-ray photoelectron spectroscopy can be 7.0 atoms % or more. In addition to this, the ratio of silicon atoms to all atoms excluding hydrogen atoms at 0.1 μm deep from the uppermost surface of the surface layer as measured using X-ray photoelectron spectroscopy can be 0.5 atoms % or more. This should further reduce streak-like image defects by ensuring that a lubricant that provides an adequate degree of lubricity also exists in the inside of the surface layer and maintains the lubricity of the surface layer during repeated use. The ratio of silicon atoms to all atoms excluding hydrogen atoms at the uppermost surface of the surface layer can be the ratio of the silicon atoms derived from the siloxane-modified acrylic compound. The ratio of silicon atoms to all atoms excluding hydrogen atoms at the uppermost surface of the surface layer is preferably 8 atoms % or more and 15 atoms % or less, in particular, 12 atoms % or less. The ratio of silicon atoms to all atoms excluding hydrogen atoms at 0.1 μm deep from the uppermost surface of the surface layer is preferably 0.9 atoms % or more and 2.0 atoms % or less, in particular, 1.4 atoms % or less.

The surface layer can be formed by preparing a surface-layer-forming coating liquid that contains a hole transporting substance having an acryloyloxy group or a methacryloyloxy group and also contains a siloxane-modified acrylic compound, forming a coat of the coating liquid for forming a surface layer, and curing this coat.

The siloxane-modified acrylic compound content of the coating liquid for forming a surface layer can be 0.5% by mass or more and 3.0% by mass or less with respect to the hole transporting substance. Making the siloxane-modified acrylic compound content in this range ensures the lubricity-related advantages of the present application, further reducing image smearing and streak-like image defects.

The surface layer may have a shape of a depression so that the stability of a cleaning blade should be further improved. An example of a way to form a shape of a depression in the surface of the surface layer is to bring a mold member having a protrusion into pressure-contact with the surface layer to form the surface of the surface layer with a depression that fits the protrusion.

When the surface layer is a protective layer, its thickness can be 0.1 μm or more and 15 μm or less, preferably 0.5 μm or more and 10 μm or less.

The solvent used to prepare the coating liquid for forming a surface layer can be one that does not dissolve the layer that lies underneath. An example is an alcohol-based solvent in which the siloxane-modified acrylic compound dissolves well.

An example of a way to cure a coat of the coating liquid for forming a surface layer is to cure it using heat, ultraviolet radiation, or electron radiation. By curing the coat using ultraviolet radiation or electron radiation, the strength of the surface layer and the durability of the electrophotographic photosensitive member can be maintained.

Polymerization using electron radiation gives a very dense (high-density) cured product (a three-dimensionally cross-linked structure) and thereby provides a highly durable protective layer. Examples of accelerators that can be used for irradiation with electron radiation include scanning accelerators, Electrocurtain accelerators, broad-beam accelerators, pulse accelerators, and laminar accelerators.

When electron radiation is used, the acceleration voltage for the electron radiation can be 120 kV or less so that the damage the electron radiation causes to the characteristics of the materials can be reduced without affecting the efficiency of polymerization. The absorbed dose of the electron radiation at the surface of the coat of the coating liquid for forming a surface layer can be 5 kGy or more and 50 kGy or less, preferably 1 kGy or more and 10 kGy or less.

Curing (polymerizing) the composition using electron radiation may include, after irradiating the composition with the electron radiation in an inert gas atmosphere, heating the irradiated composition in the inert gas atmosphere so that the inhibitory effects of oxygen on the polymerization can be reduced. Examples of inert gases include nitrogen, argon, and helium.

Support

The support used in the electrophotographic photosensitive member can be an electroconductive one (an electroconductive support). Examples include supports made of metals or alloys such as iron, copper, gold, silver, aluminum, zinc, titanium, lead, nickel, tin, antimony, indium, aluminum alloys, and stainless steel. Metal or plastic supports having a coating of aluminum, an aluminum alloy, an indium oxide-tin oxide alloy, or any similar material formed using vacuum deposition can also be used. It is also possible to use a support formed by impregnating a plastic support with carbon black, tin oxide particles, titanium oxide particles, silver particles, or any other kind of electroconductive particles or a support that contains an electroconductive polymer. The support can be in the shape of a cylinder, a belt, a sheet, or a plate, for example. In an embodiment of the invention, a cylindrical support is preferred.

The surface of the support may be subjected to cutting, roughening, anodizing, or any other process for reducing the interference fringes that occur when laser light scatters.

An electroconductive layer may be provided between the support and the photosensitive layer or an undercoat layer to reduce the interference fringes that occur when laser light or any other light scatters or to cover any scratch on the support.

The electroconductive layer can be formed by applying a coating liquid for forming an electroconductive layer to form a coat and then drying and/or curing the resulting coat. The coating liquid for forming an electroconductive layer can be obtained by dispersing electroconductive particles with a binding polymer and a solvent.

Examples of electroconductive particles used in the electroconductive layer include carbon black, acetylene black, particles of metals such as aluminum, nickel, iron, Nichrome, copper, zinc, and silver, particles of metal oxides such as zinc oxide, titanium oxide, tin oxide, antimony oxide, indium oxide, bismuth oxide, and ITO. Tin-doped indium oxide and antimony- or tantalum-doped tin oxide can also be used.

Examples of solvents for the coating liquid for forming an electroconductive layer include ether-based ones, alcohol-based ones, ketone-based ones, and ones based on aromatic hydrocarbons. The thickness of the electroconductive layer can be 0.1 μm or more and 50 μm or less, preferably 0.5 μm or more and 40 μm or less, more preferably 1 μm or more and 30 μm or less.

Examples of binding polymers used in the electroconductive layer include polymers and copolymers of vinyl compounds such as styrene, vinyl acetate, vinyl chloride, acrylates, methacrylates, vinylidene fluoride, and trifluoroethylene as well as polyvinyl alcohol polymers, polyvinyl acetal polymers, polycarbonate polymers, polyester polymers, polysulfone polymers, polyphenylene oxide polymers, polyurethane polymers, cellulose polymers, phenolic polymers, melamine polymers, silicone polymers, epoxy polymers, and isocyanate polymers.

An undercoat layer (an intermediate layer) may be provided between the support and an electroconductive layer or a charge generating layer.

The undercoat layer can be formed by applying a coating liquid for forming an undercoat layer to form a coat and then drying the resulting coat. The coating liquid for forming an undercoat layer can be obtained by dissolving a binding polymer in a solvent.

Examples of binding polymers used in the undercoat layer include polyvinyl alcohol polymers, poly-N-vinyl imidazole, polyethylene oxide polymers, ethyl cellulose, ethylene-acrylic acid copolymers, casein, polyamide polymers, N-methoxymethylated 6-nylon polymers, nylon copolymers, phenolic polymers, polyurethane polymers, epoxy polymers, acrylic polymers, melamine polymers, and polyester polymers.

The undercoat layer may further contain metal oxide particles. Examples include particles containing titanium oxide, zinc oxide, tin oxide, zirconium oxide, or aluminum oxide. The metal oxide particles may be ones having their surface treated with a surface-treatment agent such as a silane coupling agent.

Examples of solvents used in the coating liquid for forming an undercoat layer include organic solvents such as alcohol-based solvents, sulfoxide-based solvents, ketone-based solvents, ether-based solvents, ester-based solvents, solvents based on halogenated aliphatic hydrocarbons, and aromatic compounds. The thickness of the undercoat layer can be 0.05 μm or more and 30 μm or less, preferably 1 μm or more and 25 μm or less. The undercoat layer may further contain organic polymer fine particles and a leveling agent.

Photosensitive Layer

A photosensitive layer is provided on the support, an electroconductive layer, or an undercoat layer. Examples of photosensitive layers include a monolayer photosensitive layer, which contains both a charge generating substance and a charge transporting substance, and a multilayer photosensitive layer, which has a charge generating layer containing a charge generating substance and a charge transporting layer containing a charge transporting substance. In an embodiment of the invention, a multilayer photosensitive layer is preferred.

When the photosensitive layer is a multilayer one, its charge generating layer can be formed by applying a coating liquid for forming a charge generating layer to form a coat and then drying this coat. The coating liquid for forming a charge generating layer can be obtained by mixing a charge generating substance and a binding polymer with a solvent and then dispersing them in the solvent. The charge generating layer may also be a deposited coating of a charge generating substance.

Examples of charge generating substances used in the charge generating layer include azo pigments, phthalocyanine pigments, indigo pigments, perylene pigments, polycyclic quinone pigments, squarylium dyes, pyrylium salts, thiapyrylium salts, triphenylmethane dyes, quinacridone pigments, azulenium salt pigments, cyanine dyes, anthanthrone pigments, pyranthrone pigments, xanthene dyes, quinone imine dyes, and styryl dyes. Any single charge generating substance can be used alone, and it is also possible to use two or more charge generating substances. Phthalocyanine pigments and azo pigments, in particular phthalocyanine pigments, exhibit good sensitivity among other charge generating substances.

Oxytitanium phthalocyanine, chlorogallium phthalocyanine, and hydroxygallium phthalocyanine, among other phthalocyanine pigments, exhibit a particularly high efficiency in generating charge. A crystalline hydroxygallium phthalocyanine having a crystal form that gives intense peaks at Bragg angles 2θ of 7.4°±0.3° and 28.2°±0.3° in CuKα characteristic X-ray diffractometry, among other forms of hydroxygallium phthalocyanine, exhibits good sensitivity.

Examples of binding polymers used in the charge generating layer include polymers of vinyl compounds such as styrene, vinyl acetate, vinyl chloride, acrylates, methacrylates, vinylidene fluoride, and trifluoroethylene as well as polyvinyl alcohol polymers, polyvinyl acetal polymers, polycarbonate polymers, polyester polymers, polysulfone polymers, polyphenylene oxide polymers, polyurethane polymers, cellulose polymers, phenolic polymers, melamine polymers, silicone polymers, and epoxy polymers.

The mass ratio between the charge generating substance and the binding polymer (the charge generating substance to the binding polymer) can be in the range of 1:0.3 to 1:4.

Examples of methods for dispersion include methods in which a homogenizer, ultrasonic dispersion, a ball mill, a vibration ball mill, a sand mill, an attritor, or a roll mill is used.

Examples of solvents used in the coating liquid for forming a charge generating layer include alcohol-based ones, sulfoxide-based ones, ketone-based ones, ether-based ones, ester-based ones, ones based on halogenated aliphatic hydrocarbons, and aromatic compounds.

The thickness of the charge generating layer can be 0.01 μm or more and 5 μm or less, preferably 0.1 μm or more and 1 μm or less. Various sensitizers, antioxidants, ultraviolet absorbers, and plasticizers may optionally be added to the charge generating layer.

The following describes the charge transporting layer. The charge transporting layer is formed on the charge generating layer. The charge transporting layer can be formed by applying a coating liquid for forming a charge transporting layer to form a coat and then drying the resulting coat. The coating liquid for forming a charge transporting layer can be obtained by dissolving a charge transporting substance and a binding polymer in a solvent.

Examples of binding polymers used in the charge transporting layer include polyvinyl butyral, polycarbonate polymers, polyester polymers, phenoxy polymers, polyvinyl acetate, acrylic polymers, polyacrylamide, polyamides, polyvinyl pyridine, cellulose polymers, urethane polymers, and epoxy polymers. Polycarbonate polymers are preferred.

Examples of charge transporting substances used in the charge transporting layer include triarylamine compounds, hydrazone compounds, stilbene compounds, pyrazoline compounds, oxazole compounds, triallylmethane compounds, and thiazole compounds. Any single charge transporting substance can be used alone, and it is also possible to use two or more charge transporting substances.

The proportions of the charge transporting substance and the binding polymer in the charge transporting layer can be such that the amount of the charge transporting substance is 0.3 parts by mass or more and 10 parts by mass or less per 1 part by mass of the binding polymer.

The drying temperature can be 60° C. or more and 150° C. or less, preferably 80° C. or more and 120° C. or less, so that the charge transporting layer should be prevented from cracking. The duration of drying can be 10 minutes or more and 60 minutes or less.

Examples of solvents used in the coating liquid for forming a charge transporting layer include alcohol solvents, sulfoxide solvents, ketone solvents, ether solvents, ester solvents, halogenated aliphatic hydrocarbon solvents, and aromatic hydrocarbon solvents. The thickness of the charge transporting layer can be in the range of 5 μm to 40 μm, in particular, 10 μm to 35 μm.

Antioxidants, ultraviolet absorbers, plasticizers, metal oxide particles, and inorganic particles may optionally be added to the charge transporting layer. Other materials such as particles of fluorinated polymers and silicone-containing polymer particles may also be contained.

The coating liquids for the individual layers can be applied using coating techniques such as dip coating, spray coating, ring coating, spin coating, roller coating, wire-bar coating, and blade coating.

FIG. 1 illustrates an example of a schematic structure of an electrophotographic apparatus provided with a process cartridge having an electrophotographic photosensitive member.

In FIG. 1, the cylindrical electrophotographic photosensitive member 1 is driven to rotate around a shaft 2 at a given circumferential velocity in the direction indicated by an arrow. The electrophotographic photosensitive member 1 has its surface (circumferential surface) positively or negatively charged by a charging unit (a unit for primary charging) 3 during a rotation process. Then the surface of the electrophotographic photosensitive member 1 is irradiated with exposure light (image exposure light) 4 emitted from an exposure unit (a unit for image exposure, not illustrated). The intensity of the exposure light 4 is modulated according to the time-sequence electric digital pixel signal of the intended image information. The exposure process can be done through slit exposure or scanning exposure using a laser beam, for example. In this way, an electrostatic latent image that corresponds to the intended image information is formed on the surface of the electrophotographic photosensitive member 1.

The electrostatic latent image formed on the surface of the electrophotographic photosensitive member 1 is then developed (normal development or reversal development) using toner contained in a development unit 5 to form a toner image. The toner image formed on the surface of the electrophotographic photosensitive member 1 is transferred to a transfer medium 7 by a transfer unit 6. When the transfer medium 7 is paper, it is discharged from a feeding section (not illustrated) in synchronization with the rotation of the electrophotographic photosensitive member 1 and fed into the space between the electrophotographic photosensitive member 1 and the transfer unit 6. To the transfer unit 6, furthermore, a bias power supply (not illustrated) applies a bias voltage having the polarity opposite to that of the charge the toner has. The transfer unit may be an intermediate transfer unit that has a primary transfer member, an intermediate transfer body, and a secondary transfer member.

The transfer medium 7 having the transferred toner image is separated from the surface of the electrophotographic photosensitive member 1 and conveyed to a fixing unit 8, at which the toner image is fixed. As a result, an image-bearing article (a photographic print or copy) is printed out of the electrophotographic apparatus.

The surface of the electrophotographic photosensitive member 1 from which the toner image has been transferred is cleaned by a cleaning unit 9 to remove any adhering substance such as residual toner. It is also possible to collect any residual toner with the use of, for example, the development unit. When necessary, the surface of the electrophotographic photosensitive member 1 is again used to form the image after the charge is removed through irradiation with pre-exposure light 10 emitted from a pre-exposure unit (not illustrated). When the charging unit 3 is a contact charging unit, i.e., a charging unit that works using a charging roller or any similar device, the pre-exposure unit may be unnecessary.

Two or more selected from these components including the electrophotographic photosensitive member 1, the charging unit 3, the development unit 5, and the cleaning unit 9 are integrally held in a container to make up a process cartridge. This process cartridge may be attachable to and detachable from a main body of a photocopier, a laser beam printer, or any other electrophotographic apparatus. In FIG. 1, the electrophotographic photosensitive member 1, the charging unit 3, the development unit 5, and the cleaning unit 9 are integrally held in a cartridge, making up a process cartridge 11 that can be attached to and detached from a main body of the electrophotographic apparatus using a guiding unit 12 of the electrophotographic apparatus, such as rails.

EXAMPLES

The following describes certain aspects of the invention in more detail by providing specific examples. The term "parts" in the following examples refers to "parts by mass."

Example 1

An aluminum cylinder having a diameter of 30 mm, a length of 357.5 mm, and a thickness of 1 mm was used as a support (an electroconductive support).

Then 100 parts of zinc oxide particles (specific surface area, 19 $m^2/g$; powder resistivity, $4.7\times10^6$ Ω·cm) were mixed and stirred with 500 parts of toluene, 0.8 parts of a silane coupling agent was added, and the resulting mixture was stirred for 6 hours. After toluene was distilled off under reduced pressure, the residue was dried through heating at 130° C. for 6 hours, yielding surface-treated zinc oxide particles. The silane coupling agent was KBM602 (Shin-Etsu Chemical; compound name, N-2-(aminoethyl)-3-aminopropyl methyl dimethoxy silane).

Then 15 parts of a polyvinyl butyral polymer (a polyol polymer; weight-average molecular weight, 40000; trade name, BM-1; Sekisui Chemical) and 15 parts of a blocked isocyanate (trade name, Sumidur 3175; Sumika Bayer Urethane) were dissolved in a mixture of 73.5 parts of methyl ethyl ketone and 73.5 parts of 1-butanol. To the resulting solution, 80.8 parts of the surface-treated zinc oxide particles and 0.8 parts of 2,3,4-trihydroxybenzophenone (Tokyo Chemical Industry) were added. The added ingredients were dispersed in an atmosphere at 23° C.±3° C. for 3 hours using sand mill equipment with 0.8-mm glass beads. The resulting dispersion was stirred with 0.01 parts of silicone oil (trade name, SH28PA; Dow Corning Toray) and 5.6 parts of polymethylmethacrylate (PMMA) particles (trade name, TECHPOLYMER SSX-102; Sekisui Plastics; average primary particle diameter, 2.5 μm), yielding a coating liquid for forming an undercoat layer.

This coating liquid for forming an undercoat layer was applied to the aforementioned aluminum cylinder through dip coating to form a coat. The obtained coat was dried at 160° C. for 40 minutes, yielding an undercoat layer having a thickness of 18 μm.

Then a crystalline hydroxygallium phthalocyanine having a crystal form that gives intense peaks at Bragg angles 2θ±0.2° of 7.4° and 28.2° in CuKα characteristic X-ray diffractometry was prepared. Twenty parts of this crystalline hydroxygallium phthalocyanine, 0.2 parts of the compound represented by formula (1), 10 parts of a polyvinyl butyral polymer (trade name, S-LEC BX-1; Sekisui Chemical), and 600 parts of cyclohexanone were mixed and dispersed using sand mill equipment with 1-mm glass beads for 4 hours. Then 700 parts of ethyl acetate was added, yielding a coating liquid for forming a charge generating layer. This coating liquid for forming a charge generating layer was applied to the undercoat layer through dip coating to form a coat. The obtained coat was dried through heating in an oven at a temperature of 80° C. for 15 minutes, yielding a charge generating layer having a thickness of 0.17 μm.

(1)

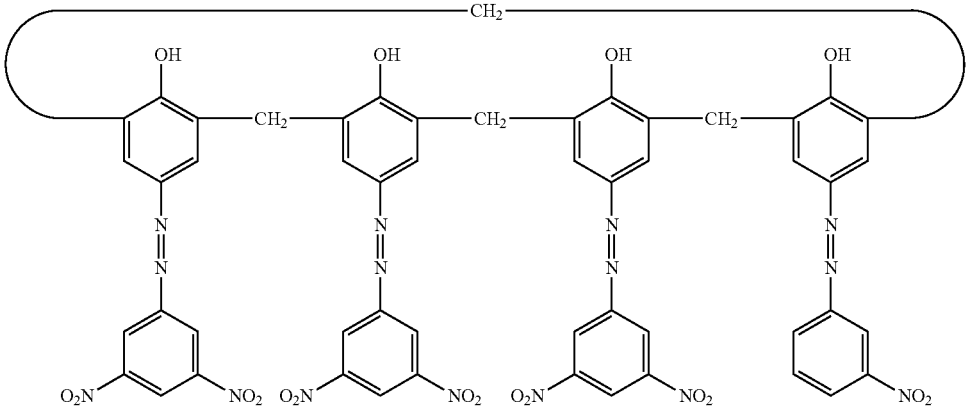

Then 30 parts of the compound represented by formula (3) (a charge transporting substance), 60 parts of the compound represented by formula (4) (a charge transporting substance), 10 parts of the compound represented by formula (5), 100 parts of a polycarbonate polymer (trade name, Iupilon 2400; Mitsubishi Engineering-Plastics; a bisphenol-Z type polymer), and 0.02 parts of a polycarbonate having structural units represented by formulae (6-1) and (6-2) (viscosity-average molecular weight Mv, 20000) were dissolved in a solvent composed of 600 parts of mixed xylene and 200 parts of dimethoxymethane, yielding a coating liquid for forming a charge transporting layer. This coating liquid for forming a charge transporting layer was applied to the charge generating layer through dip coating to form a coat. The obtained coat was dried at 100° C. for 30 minutes, yielding a charge transporting layer having a thickness of 18 μm.

(3)

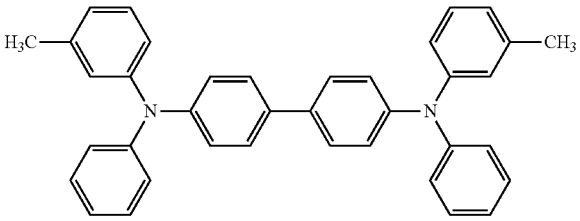

(4)

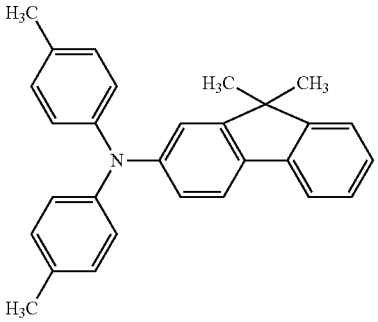

-continued (5)

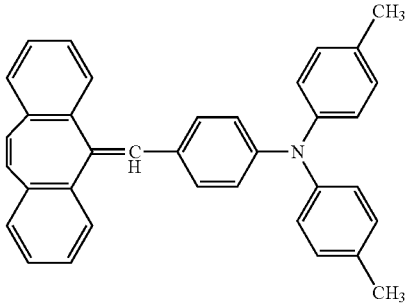

(6-1)

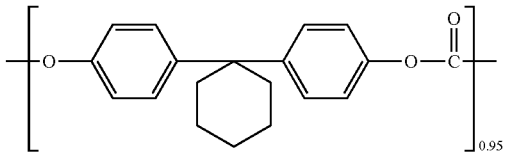

(6-2)

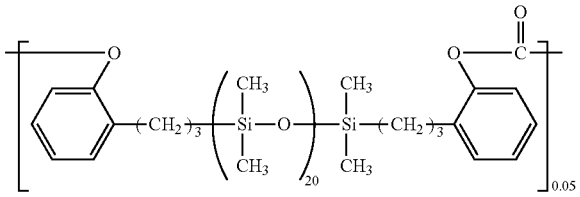

Then 100 parts of the aforementioned illustrative compound (1-1), 3.5 parts of a solution containing a siloxane-modified acrylic compound (BYK-3550, BYK Japan KK, a 52 mass % methoxypropyl acetate solution), and 300 parts of 1-propanol were mixed and stirred. The siloxane-modified acrylic compound was highly compatible with the other ingredients. The resulting solution was filtered through a Polyflon filter (trade name, PF-020; Advantec Toyo Kaisha), yielding a coating liquid for forming a surface layer. BYK-3550 is a copolymer composed of an acrylic backbone and a siloxane polymer grafted to the acrylic backbone. The siloxane-modified acrylic compound content of the coating liquid for forming a surface layer is 1.82% by mass with respect to the hole transporting substance.

The solubility of the siloxane-modified acrylic compound (BYK-3550) in 1-propanol was measured as follows. Under 25° C. and 1-atm conditions, 0.2 g of the siloxane-modified acrylic compound-containing solution (BYK-3550) was mixed in 10 g of 1-propanol. The siloxane-modified acrylic compound was compatible with 1-propanol with no separation of liquids. The solubility of the siloxane-modified acrylic compound (BYK-3550) in 1-propanol was therefore 1% by mass or more.

This coating liquid for forming a protective layer was applied to the charge transporting layer through dip coating to form a coat. The obtained coat was dried in the air at 50° C. for 10 minutes. Then in a nitrogen atmosphere, the coat was irradiated with electron radiation for 1.6 seconds with the acceleration voltage and beam current settings at 150 kV and 3.0 mA, respectively, while the support (the workpiece) was rotated at a speed of 200 rpm. The absorbed dose of the electron radiation measured during this process was 15 kGy. Then the coat was heated in a nitrogen atmosphere in such a manner that the temperature of the coat should increase from 25° C. to 125° C. over 30 seconds. The oxygen concentration during the period from the irradiation with electron radiation to the heating was 15 ppm or less. Then the coat was allowed to cool in the air until the temperature of the coat was 25° C. The cooled coat was then heated in the air for 30 minutes under such conditions that the temperature of the coat should be 100° C., yielding a protective layer (a surface layer) having a thickness of 5 μm.

In this way, an electrophotographic photosensitive member having no depressions in its surface (an undepressed electrophotographic photosensitive member) was prepared.

Then the surface of the prepared undepressed electrophotographic photosensitive member was treated using a processor for pressure-contact shape transfer with a mold member. The mold member is composed of an elastic layer (silicone rubber), a metal layer (stainless steel), and a transfer layer (nickel). The transfer layer had a textured surface formed by protrusions randomly arranged on a flat surface (using an error-diffusion algorithm [the Floyd and Steinberg algorithm]). Each protrusion is dome-shaped, having a diameter of 50 μm and a height of 2 μm. The area of these protrusions was 10% of that of the entire surface of the transfer layer.

During the surface processing, the temperature of the electrophotographic photosensitive member and the mold member was controlled so that the temperature of the surface of the electrophotographic photosensitive member should be 110° C. while the electrophotographic photosensitive member was rotated in the circumferential direction with the electrophotographic photosensitive member and a pressing member pressed against each other. In this way, depressions were formed over the entire surface (circumferential surface) of the electrophotographic photosensitive member. An electrophotographic photosensitive member was produced in this way.

The obtained electrophotographic photosensitive member was analyzed using X-ray photoelectron spectroscopy (PHI 5000, ULVAC-PHI, Inc.) for the ratio (atoms %) of silicon atoms to all atoms excluding hydrogen atoms at the uppermost surface of the surface layer and 0.1 μm deep from the uppermost surface.

Then the obtained electrophotographic photosensitive member was installed in the cyan station of a test apparatus, a modified Canon electrophotographic apparatus (photocopier) (trade name, iR-ADV C5051), and images produced under 23° C. and 5% RH and 30° C. and 80% RH conditions were evaluated.

The procedure for evaluating the images was as follows. First, the cassette heater (drum heater) in the apparatus was turned off with the total discharge current setting for charging at 150 μA. Then an image was continuously formed on 30000 sheets using a test chart having a 5% image-recorded area. The apparatus was left unused for 3 days after this image formation process, and then an A4 horizontal, 17-tone image was formed with an output resolution of 600 dpi. The obtained full A4 image was evaluated as follows.

A: Good image reproduction with no vertical streaks or image smearing

B: Good image reproduction except in a limited area with vertical streaks or image smearing C: Good image reproduction with some defects observed when magnified D: Poor image reproduction with obvious vertical streaks or image smearing The results are summarized in the Table.

Examples 2 and 3

An electrophotographic photosensitive member was produced and evaluated in the same way as in Example 1 except that the amount of the siloxane-modified acrylic compound was changed to the amount specified in the Table.

Example 4

An electrophotographic photosensitive member was produced and evaluated in the same way as in Example 1 except that the 100 parts of illustrative compound (1-1) was changed to 100 parts of illustrative compound (1-2).

Example 5

An electrophotographic photosensitive member was produced and evaluated in the same way as in Example 1 except that the 100 parts of illustrative compound (1-1) was changed to 100 parts of illustrative compound (1-3).

Example 6

An electrophotographic photosensitive member was produced and evaluated in the same way as in Example 1 except that the surface layer was formed as follows.

One hundred parts of illustrative compound (1-1), 3.5 parts of a siloxane-modified acrylic compound-containing solution (BYK-3550), 15 parts of 2,4-diethylthioxanthone as a photopolymerization initiator, 5 parts of 4,4-bis(diethylamino)benzophenone as a polymerization aid, and 300 parts of 1-propanol were mixed. The resulting solution was filtered through a Polyflon filter (trade name, PF-020; Advantec Toyo Kaisha), yielding a coating liquid for forming a surface layer.

Then this coating liquid for forming a surface layer was applied to the charge transporting layer through dip coating to form a coat. The coat was irradiated with ultraviolet radiation using a metal halide lamp at a light intensity of $1.20\times10^{-5}$ W/m$^2$ for 30 seconds for photocuring. The cured coat was then dried through heating at 120° C. for 1 hour and 40 minutes, yielding a surface layer having a thickness of 5 μm.

Reference Example 7 to 9

An electrophotographic photosensitive member was produced and evaluated in the same way as in Example 1 except that the amount of the siloxane-modified acrylic compound was changed to the amount specified in the Table.

Example 10

An electrophotographic photosensitive member was produced and evaluated in the same way as in Example 1 except that no depressions were formed in the surface layer.

Example 11

The coating liquid for forming a protective layer was applied to the charge transporting layer through dip coating to form a coat. The coat was dried with hot air at 150° C. for 1 hour in an atmosphere containing 200 ppm oxygen, yielding a surface layer having a thickness of 5 μm.

Except for this, the same procedure as in Example 1 was followed to produce and evaluate a photosensitive member.

Example 12

An electrophotographic photosensitive member was produced and evaluated in the same way as in Example 1 except that the 300 parts of 1-propanol used in the coating liquid for forming a protective layer was changed to 300 parts of tetrahydrofuran.

Comparative Example 1

An electrophotographic photosensitive member was produced and evaluated in the same way as in Example 1 except that illustrative compound (1-1) was changed to the compound represented by formula (C-1) and that no siloxane-modified acrylic compound was added.

(C-1)

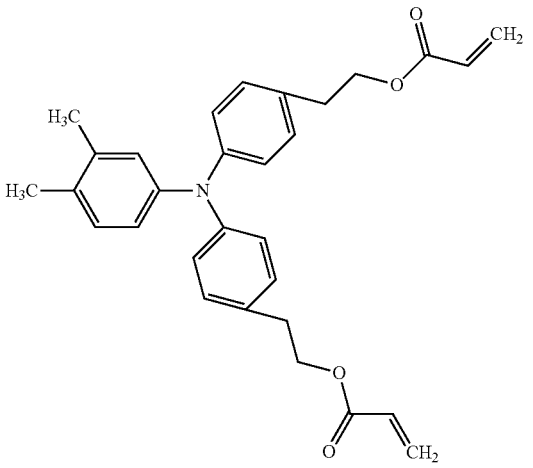

Comparative Example 2

An electrophotographic photosensitive member was produced and evaluated in the same way as in Comparative Example 1 except that the siloxane-modified acrylic compound was changed to a surfactant including a structure in which a fluorinated acrylic monomer was in a polymerized form (trade name, KL-600; Kyoeisha Chemical).

Comparative Example 3

An electrophotographic photosensitive member was produced and evaluated in the same way as in Comparative Example 1 except that the coating liquid for forming a protective layer was prepared as follows.

One hundred parts of the compound represented by formula (C-1), 25 parts of polytetrafluoroethylene particles (trade name, Lubron L-2; Daikin Industries), and 1.25 parts of a fluorinated polymer (trade name, GF 300; Toagosei Co., Ltd.) were mixed and dispersed in 300 parts of n-propyl alcohol, yielding a coating liquid for forming a protective layer.

Comparative Example 4

An electrophotographic photosensitive member was produced and evaluated in the same way as in Comparative Example 3 except that the surfactant was changed to 1.82 parts of methyl hydrogen polysiloxane (viscosity, 100 cp).

Comparative Example 5

With reference to sample (h) Japanese Patent Laid-Open No. 62-75462 describes in Example 3, a copolymer of styrene and a siloxane-modified acrylic compound having the same composition as this sample was prepared except that 80 parts of styrene was changed to 90 parts of styrene. An attempt to prepare a coating liquid for forming a surface layer using 1.82 parts of this styrene-siloxane-modified acrylic copolymer instead of the siloxane-modified acrylic compound in Example 1 failed with insufficient dissolution after stirring. The solubility of the styrene-siloxane-modified acrylic copolymer in 1-propanol was measured as follows. Under 25° C. and 1-atm conditions, 0.1 g of the styrene-siloxane-modified acrylic copolymer was mixed in 10 g of 1-propanol. Only a little of the styrene-siloxane-modified acrylic copolymer was dissolved. The solubility of the styrene-siloxane-modified acrylic copolymer in 1-propanol was therefore less 0.1% by mass. Then 0.1 g of the styrene-siloxane-modified acrylic copolymer was dissolved in 1 g of chlorobenzene, yielding a solution containing the styrene-siloxane-modified acrylic copolymer. Mixing 1.1 g of this solution containing the styrene-siloxane-modified acrylic copolymer in 9 g of 1-propanol made the liquid turbid, indicating that the styrene-siloxane-modified acrylic copolymer separated out.

TABLE

| | Additive | Content | XPS Si ratio (uppermost surface) | XPS Si ratio (0.1 μm deep) | Initial image level | Image level after printing 30000 sheets |
|---|---|---|---|---|---|---|
| Example 1 | Siloxane-modified acrylic compound | 1.82% | 9.1% | 1.0% | A | A |
| Example 2 | Siloxane-modified acrylic compound | 3.0% | 12.0% | 1.4% | A | A |

TABLE-continued

| | Additive | Content | XPS Si ratio (uppermost surface) | XPS Si ratio (0.1 μm deep) | Initial image level | Image level after printing 30000 sheets |
|---|---|---|---|---|---|---|
| Reference Example 3 | Siloxane-modified acrylic compound | 0.5% | 7.4% | 0.5% | A | A |
| Example 4 | Siloxane-modified acrylic compound | 1.82% | 8.8% | 1.1% | A | A |
| Example 5 | Siloxane-modified acrylic compound | 1.82% | 8.7% | 1.3% | A | A |
| Example 6 | Siloxane-modified acrylic compound | 1.82% | 9.1% | 1.0% | A | A |
| Reference Example 7 | Siloxane-modified acrylic compound | 0.25% | 7.4% | 0.5% | A | B |
| Reference Example 8 | Siloxane-modified acrylic compound | 0.05% | 1.7% | 0.2% | A | C |
| Reference Example 9 | Siloxane-modified acrylic compound | 3.5% | 12.8% | 1.8% | A | B |
| Example 10 | Siloxane-modified acrylic compound | 1.82% | 9.1% | 1.0% | A | B |
| Example 11 | Siloxane-modified acrylic compound | 1.82% | 9.1% | 1.0% | A | C |
| Example 12 | Siloxane-modified acrylic compound | 1.82% | 9.1% | 1.0% | B | C |
| Comparative Example 1 | None | 1.82% | 0.0% | 0.0% | A | D |
| Comparative Example 2 | Fluorinated acrylic compound | 1.82% | 0.0% | 0.0% | B | D |
| Comparative Example 3 | Polytetrafluoroethylene | — | 0.0% | 0.0% | C | D |
| Comparative Example 4 | Methyl hydrogen polysiloxane | 1.82% | 10% | 0.2% | A | D |
| Comparative Example 5 | Styrene-siloxane-modified acrylic copolymer | 1.82% | Not sufficiently dissolved in the coating liquid | | | |

In the Table, "Content" represents the content ratio of the additive to the hole transporting substance in the coating liquid for forming a surface layer. "XPS Si ratio" represents the ratio of silicon atoms to all atoms excluding hydrogen atoms as measured using X-ray photoelectron spectroscopy (XPS) at the surface of the surface layer or 0.1 μm deep from the uppermost surface.

The evaluation revealed that in Examples image smearing and streak-like image defects during repeated use were sufficiently reduced, whereas in Comparative Examples image smearing and streak-like image defects during repeated use were not sufficiently reduced.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-214819 filed Oct. 15, 2013 and No. 2014-176308 filed Aug. 29, 2014, which are hereby incorporated by reference herein in their entirety.

What is claimed is:

1. An electrophotographic photosensitive member comprising:

an electroconductive support, and a photosensitive layer formed on the electroconductive support, wherein a surface layer of the electrophotographic photosensitive member comprises a cured product of a composition comprising:

a hole transporting substance having at least one group selected from the group consisting of an acryloyloxy group and a methacryloyloxy group, and a siloxane-modified acrylic compound having a siloxane structure as a side chain on an acrylic backbone;

wherein a ratio of silicon atoms to all atoms excluding hydrogen atoms at an uppermost surface of the surface layer as measured using X-ray photoelectron spectroscopy is 8.0 atoms % or more and 12 atoms % or less, and a ratio of silicon atoms to all atoms excluding hydrogen atoms at 0.1 μm deep from the uppermost surface of the surface layer as measured using X-ray photoelectron spectroscopy is 0.9 atoms % or more and 1.4 atoms % or less.

2. The electrophotographic photosensitive member according to claim 1, wherein the siloxane-modified acrylic compound is a copolymer composed of an acrylic backbone and a siloxane polymer grafted to the acrylic backbone.

3. The electrophotographic photosensitive member according to claim 1, wherein the siloxane-modified acrylic compound is one whose solubility is 1% by mass or more in 1-propanol.

4. The electrophotographic photosensitive member according to claim 1, wherein a surface of the surface layer has a depression.

5. The electrophotographic photosensitive member according to claim 1, wherein the hole transporting substance is a compound represented by formula (1):

$$(P^1—Z)_a A \quad (1)$$

wherein A represents a hole transporting group, Z represents a single bond or a substituted or unsubstituted alkylene group having 1 to 6 carbon atoms along a backbone, $P^1$ represents an acryloyloxy group or a methacryloyloxy group, "a" is an integer of 1 to 4, and when "a" is 2 or more, the 2 or more P's may be the same as or different from one another.

6. The electrophotographic photosensitive member according to claim 1, wherein the photosensitive layer comprises a charge generating layer and a charge transporting layer formed on the charge generating layer, and the electrophotographic photosensitive member further comprises a protective layer on the charge transporting layer, and the protective layer is the surface layer.

7. A method for producing an electrophotographic photosensitive member comprising an electroconductive support and a surface layer formed on the electroconductive support, the method comprising:

preparing a coating liquid for forming the surface layer, the coating liquid comprising a hole transporting substance having at least one group selected from the group consisting of an acryloyloxy group and a methacryloyloxy group, and a siloxane-modified acrylic compound having a siloxane structure as a side chain on an acrylic backbone, wherein a ratio of silicon atoms to all atoms excluding hydrogen atoms at an uppermost surface of the surface layer as measured using X-ray photoelectron spectroscopy is 8.0 atoms % or more and 12 atoms % or less, and a ratio of silicon atoms to all atoms excluding hydrogen atoms at 0.1 μm deep from the uppermost surface of the surface layer as measured using X-ray photoelectron spectroscopy is 0.9 atoms % or more and 1.4 atoms % or less, and forming a coat of the coating liquid for forming the surface layer and curing the coat to form the surface layer.

8. The method for producing an electrophotographic photosensitive member according to claim 7, wherein the siloxane-modified acrylic compound is a copolymer composed of an acrylic backbone and a siloxane polymer grafted to the acrylic backbone.

9. The method for producing an electrophotographic photosensitive member according to claim 7, wherein the siloxane-modified acrylic compound is one whose solubility is 1% by mass or more in 1-propanol.

10. The method for producing an electrophotographic photosensitive member according to claim 7, wherein a content of the siloxane-modified acrylic compound in the coating liquid for forming the surface layer is 0.5% by mass or more and 3.0% by mass or less with respect to the hole transporting substance.

11. The method for producing an electrophotographic photosensitive member according to claim 7, wherein the hole transporting substance is a compound represented by formula (1):

$$(P^1—Z)_aA \quad (1)$$

wherein A represents a hole transporting group, Z represents a single bond or a substituted or unsubstituted alkylene group having 1 to 6 carbon atoms along a backbone, $P^1$ represents an acryloyloxy group or a methacryloyloxy group, "a" is an integer of 1 to 4, and when "a" is 2 or more, the 2 or more P's may be the same as or different from one another.

12. A process cartridge comprising the electrophotographic photosensitive member according to claim 1 and at least one unit selected from a charging unit, a development unit, and a cleaning unit, the process cartridge integrally holding the electrophotographic photosensitive member and the unit, wherein the process cartridge is attachable to and detachable from a main body of an electrophotographic apparatus.

13. An electrophotographic apparatus comprising the electrophotographic photosensitive member according to claim 1, a charging unit, an exposure unit, a development unit, and a transfer unit.

* * * * *